US006259888B1

(12) United States Patent
Kazama et al.

(10) Patent No.: US 6,259,888 B1
(45) Date of Patent: Jul. 10, 2001

(54) CURL CORRECTING UNIT AND IMAGE FORMING APPARATUS

(75) Inventors: Hiroatsu Kazama; Masatoshi Kimura, both of Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/454,857

(22) Filed: Dec. 7, 1999

(30) Foreign Application Priority Data

Feb. 9, 1999 (JP) ..... 11-032070

(51) Int. Cl.[7] ..... G03G 15/00

(52) U.S. Cl. ..... 399/406; 271/183

(58) Field of Search ..... 399/406, 24, 405; 271/188, 272, 273

(56) References Cited

U.S. PATENT DOCUMENTS

| | | | | |
|---|---|---|---|---|
| 5,848,347 | * | 12/1998 | Kuo et al. | 399/406 |
| 5,920,751 | * | 7/1999 | Chow et al. | 399/406 X |
| 5,937,258 | * | 8/1999 | Acquaviva et al. | 399/406 |
| 6,094,561 | * | 7/2000 | Ushio | 399/401 |

FOREIGN PATENT DOCUMENTS

| | | | |
|---|---|---|---|
| 56-48343 | | 5/1989 | (JP) . |
| 1-227178 | * | 9/1989 | (JP) . |
| 4-251067 | | 9/1992 | (JP) . |
| 8-217313 | | 8/1996 | (JP) . |
| 9-30712 | | 2/1997 | (JP) . |
| 10-139248 | * | 5/1998 | (JP) . |

* cited by examiner

*Primary Examiner*—Quana M. Grainger
(74) *Attorney, Agent, or Firm*—Oliff & Berridge, PLC

(57) ABSTRACT

A curl correcting unit in which plural curl correcting sections are sequentially arranged in a sheet transporting direction enhances curl correction in a direction to lower edge portions of a sheet. The curl correcting unit which performs curl correction on a sheet on which an image is formed by an image forming apparatus, has a first curl correcting device for applying pressure to the sheet and performing curl correction in a direction to raise the edge portions of the sheet, and a second curl correcting device for applying pressure to the sheet and performing curl correction in a direction to lower the edge portions of the sheet, the second curl correcting device being positioned downstream of a sheet transporting path with respect to the first curl correcting device, the pressure of the second curl correcting device being applied to the sheet at all times during at least transportation of the sheet.

14 Claims, 14 Drawing Sheets

(CURL NON-CORRECTION MODE)

(DOWN-CURL CORRECTION MODE)

(UP-CURL CORRECTION MODE)

DEFINITIONS OF SIDE A AND SIDE B

| | Simp (Invet) | Simp (Straight) | Duplex |
|---|---|---|---|
| SIDE A | 0 | Zℓ1,Zt1 | Zℓ2,Zt2 |
| SIDE B | Zℓ1,Zt1 | 0 | Zℓ1,Zt1 |

IMAGE CONTENTS ON SIDES A AND B (OBVERSE AND REVERSE SIDES) AND ON/OFF CONDITIONS OF DECURLER

FIG.14(a)

ON/OFF CONDITIONS OF DECURLER FOR HUMIDITY M < 40%

| SIDE B \ SIDE A | ~10 | ~20 | ~30 | ~40 | ~50 | 50~ |
|---|---|---|---|---|---|---|
| ~10 | 0 | 0 | -1 | -1 | -1 | -1 |
| ~20 | 0 | 0 | 0 | -1 | -1 | -1 |
| ~30 | 0 | 0 | 0 | 0 | -1 | -1 |
| ~40 | 1 | 0 | 0 | 0 | 0 | -1 |
| ~50 | 1 | 1 | 0 | 0 | 0 | -1 |
| 50~ | 1 | 1 | 1 | 1 | 0 | 0 |

FIG.14(b)

ON/OFF CONDITIONS OF DECURLER FOR 40% ? HUMIDITY M < 70%

| SIDE B \ SIDE A | ~10 | ~20 | ~30 | ~40 | ~50 | 50~ |
|---|---|---|---|---|---|---|
| ~10 | 0 | 0 | 0 | -1 | -1 | -1 |
| ~20 | 0 | 0 | 0 | 0 | -1 | -1 |
| ~30 | 0 | 0 | 0 | 0 | -1 | -1 |
| ~40 | 1 | 0 | 0 | 0 | 0 | -1 |
| ~50 | 1 | 1 | 0 | 0 | 0 | -1 |
| 50~ | 1 | 1 | 1 | 1 | 0 | 0 |

FIG.14(c)

ON/OFF CONDITIONS OF DECURLER FOR 70%? HUMIDITY M

| SIDE B \ SIDE A | ~10 | ~20 | ~30 | ~40 | ~50 | 50~ |
|---|---|---|---|---|---|---|
| ~10 | 0 | 0 | 0 | 0 | -1 | -1 |
| ~20 | 0 | 0 | 0 | 0 | 0 | -1 |
| ~30 | 0 | 0 | 0 | 0 | 0 | -1 |
| ~40 | 0 | 0 | 0 | 0 | 0 | 0 |
| ~50 | 1 | 0 | 0 | 0 | 0 | 0 |
| 50~ | 1 | 1 | 1 | 0 | 0 | 0 |

CURL CORRECTING UNIT AND IMAGE FORMING APPARATUS

BACKGROUND OF THE INVENTION (a) Field of the Invention

The present invention relates to an image forming apparatus for use in a printer, a copying machine, a facsimile machine and the like and, more specifically, to a curl correcting unit for effecting curl correction as well as to an image forming apparatus provided with such a curl correcting unit.

(b) Description of the Prior Art

In general, an image forming apparatus using a xerographic system, such as a laser printer or a color image copying machine, makes use of means which is arranged to expose, by laser or the like, an image carrier such as a photoconductor drum to image data inputted from a personal computer or an image input terminal (IIT) and form an electrostatic latent image on the image carrier, develop the electrostatic latent image with toner by a developing unit and transfer the toner image to a sheet (mainly, paper), fix the image by fusing the toner to the sheet by a heating roller type of fixing unit, and deliver the fixed sheet to the outside of the apparatus. In the field of such an image forming apparatus, there has been provided an apparatus of the type in which a unit for executing postprocessing such as stapling, punching and sorting is connected to an image forming apparatus for the purpose of realizing automation of postprocessing work. It has heretofore been known that, in the use of such a postprocessing unit, the state of curling of a sheet deeply concerns various factors such as the occurrence of a jam due to a failure in sheet transportation, a success or a failure in sheet registration in a sorter or the like and the level of postprocessing performance.

Since the curl of a sheet varies according to the kind of sheet, temperature, humidity and the like, there already exists an art which detects humidity, the moisture content of a sheet, the kind of sheet and sheet thickness and adjusts a curl correction quantity, as disclosed in, for example, Japanese Patent Laid-Open No. 251067/1992. In addition, although toner transferred to a sheet is heated for fixation and, after delivered from the postprocessing unit, shrinks with a decrease in temperature, this shrinkage greatly affects the curl of the sheet. In view of this fact, for example, Japanese Patent laid-Open Nos. 217313/1996 and 30712/1997 discloses the art of adjusting a curl correction quantity according to the image density or the detection of result of the amount of toner.

In the art disclosed in any of these specifications, curl correcting parts for effecting different corrections on the basis of the curl correction quantity determined in the above-described manner are disposed along different sheet transporting paths, and the transporting path of a sheet is selectively switched over, thereby effecting curl correction on the sheet. One of the curl correcting parts is provided for effecting the correction of curving a down curl, which acts to lower the edge portions of a sheet, upwardly (outwardly in the downward directions on the basis of the curl correction quantity, while the other curl correcting part is provided for effecting the correction of curving an up curl, which acts to raise the edge portions of a sheet, downwardly (outwardly in the upward direction) on the basis of the curl correction quantity.

Japanese Patent Laid-Open No. 48343/1981 discloses the art of detecting the curling direction of a sheet and carrying out correction of a down curl or an up curl by means of curl correcting parts which are sequentially arranged along an identical path. In this art, solenoids are individually disposed in the respective curl correcting parts, and the solenoids are alternatively operated to correct and flatten a sheet, thereby effecting curl correction.

However, it is in general difficult to reliably detect the state of a curl-corrected sheet and newly apply curl correction to the sheet, and a certain extent of curl remains even if settings which aim at flattening or straightening the sheet are adopted. In this case, for example, if a sheet is delivered to a delivery tray with an up curl remaining in the sheet, as shown in FIG. 15(*a*), the previous delivered sheet covers a delivery portion and blocks the next sheet to be delivered, thus leading to a stacking failure in which the previous delivered sheet rolls and the next delivered sheet covers the rolled sheet, or a delivery failure in which the next sheet fails to be reliably delivered. In particular, if a multiplicity of sheets are stacked on a delivery tray, even a small up curl will eventually cause such a trouble. On the other hand, if a sheet is delivered in a down-curled state as shown in FIG. 15(*b*), the occurrence of any of the above-described troubles can be prevented.

Such a problem conspicuously appears when a sheet passes through only a curl correcting part which is disposed along one of sheet transporting paths to carry out correction of a down curl, as disclosed in Japanese Patent Laid-Open Nos. 251067/1992, 217313/1996 and 30712/1997. In addition, even if one curl correcting part is to be alternatively selected from curl correcting parts which are sequentially arranged along an identical sheet transporting path, as disclosed in Japanese Patent Laid-Open No. 48343/1981, a similar trouble will occur when only the correction of a down curl is selected or an up curl is insufficiently corrected.

In addition, if a down-curl correcting part and an up-curl correcting part are sequentially arranged in a sheet transporting direction and are driven by an identical driving source, the driving source can be made simple and a great reduction in cost can be achieved.

In Japanese Patent Laid-Open No. 48343/1981, an arbitrary curl correcting part is selected from among the curl correcting parts by means of different driving sources. However, if this art is developed to drive the curl correcting parts by an identical driving source, there may be a case in which the switchover of the curl correcting parts cannot follow the speed of sheet transportation and an unexpected curl correction may be performed on the next sheet to be delivered, by the curl correcting part for the previous delivered sheet. In such a case, if curl correction is performed in a direction in which a sheet is curved outward in the upward direction (the edge portions of the sheet are lowered), no serious problem occurs, but if curl correction is unexpectedly performed in a direction in which a sheet is curved outward in the downward direction (the edge portions of the sheet are raised), the above-described delivery troubles will occur.

Accordingly, if the down-curl correcting part and the up-curl correcting part are sequentially arranged in the sheet transporting direction, it is necessary to take measures so that, even in the worst case, a sheet can be delivered in the state of being curved outward in the upward direction (with the edge portions of the sheet being lowered).

In addition, the speed of sheet transportation is increased in order to improve the productivity of the printing speed of the image forming apparatus, and the space between sheets being transported is designed to be extremely small in order to realize a reduction in the total time period required to continuously record images an sheets.

In the case in which the down-curl correcting part and the up-curl correcting part are sequentially arranged in the sheet transporting direction, if the space between both curl correcting parts is larger than the space between sheets being continuously transported, there occurs a state in which at the same time that the previous delivered sheet is present at one of the curl correcting parts, the next sheet to be delivered is present at the other.

In this case, if the respective curl correcting parts can be quickly switched over by different driving units, no problem will occur. However, if both curl correcting parts are to be driven by an identical driving source, curl correction will have to be abandoned at either one of the curl correcting parts.

In this case, if curl correction is performed on a sheet in a direction in which the sheet is curved outward in the upward direction (in a direction in which the edge portions of the sheet are lowered), no problem will occur. However, in a case where curl correction needs to be performed on a sheet in a direction to curve the sheet outward in the upward direction (in a direction to lower the edge portions of the sheet), if curl correction is performed on the sheet in the opposite direction, an extremely serious trouble will occur during the delivery of the sheet.

SUMMARY OF THE INVENTION

The present invention has been made in order to solve the above-described technical problems, and provides a curl correcting unit and an image forming apparatus in both of which plural curl correcting sections are sequentially arranged in a sheet transporting direction with the arrangement of each of the curl correcting sections being optimized.

In accordance with one aspect of the present invention, there is provided a curl correcting unit 2 for performing curl correction on a sheet P1 (P2) on which an image is formed by an image forming apparatus 1, as shown in FIG. 1, and the curl correcting unit 2 has a first curl correcting part 3 for applying pressure to the sheet and performing curl correction in a direction to raise edge portions of the sheet, and a second curl correcting part 4 for applying pressure to the sheet and performing curl correction in a direction to lower the edge portions of the sheet. The second curl correcting part 4 is positioned downstream of a sheet transporting path with respect to the first curl correcting part 3, and the pressure of the second curl correcting part 4 is applied to the sheet P1 (P2) continuously at least during transportation of the sheet.

Particularly preferably, the curl correcting unit 2 further has a driving part 5 for operating the first curl correcting part 3 and the second curl correcting part 4, and the driving part 5 is driven on the basis of a state of curling of the sheet grasped by the image forming apparatus, whereby the curl correcting unit 2 can appropriately cope with the state of curling of the sheet.

More preferably, the driving part 5 has a cam mechanism part and drives the first curl correcting part 3 and the second curl correcting part 4 at the same time, whereby, for example, a driving system can be simplified.

In accordance with another aspect of the present invention, there is provided the curl correcting unit 2 for performing curl correction on the sheet P1 (P2) on which an image is formed by the image forming apparatus 1, and the curl correcting unit 2 has the first curl correcting section 3 for applying pressure to the sheet and performing curl correction in a direction to raise edge portions of the sheet, and the second curl correcting section 4 for applying pressure to the sheet and performing curl correction in a direction to lower the edge portions of the sheet. The second curl correcting section 4 is positioned downstream of a sheet transporting path with respect to the first curl correcting section 3, and a control section 6 drives, after the sheet has passed through the first curl correcting section 3, the second curl correcting section 4 and performs curl correction on a trailing edge portion of the sheet.

Preferably, the curl correcting unit may further have a sensor 7 for detecting the sheet between the first curl correcting section 3 and the second curl correcting section 4, and the control section 6 drives the second curl correcting section 4 by detecting the trailing edge portion of the sheet by means of the sensor 7, whereby it is possible to perform curl correction on the trailing edge portion of the sheet continuously in a direction to lower the edge portions of the sheet.

In accordance with another aspect of the present invention, there is provided an image forming apparatus for sequentially forming an image while continuously transporting plural sheets P1 and P2 with a predetermined space interposed therebetween. The image forming apparatus has the first curl correcting unit 3 for applying pressure to a sheet being transported and performing curl correction in a direction to raise edge portions of the sheet, and the second curl correcting unit 4 for applying pressure to the sheet being transported and performing curl correction in a direction to lower the edge portions of the sheet. The second curl correcting unit 4 is disposed at a location away from the first curl correcting unit 3 by a predetermined space. A space 8 between the first curl correcting unit and the second curl correcting unit is smaller than a space 9 between the sheets P1 and P2 being continuously transported.

The image forming apparatus may further have a fixing unit 10 for fixing an image transferred to each of the sheets P1 and P2, and the space 5 between the first curl correcting unit 3 and the second curl correcting unit 4 is smaller than a space to be formed by the plural sheets P1 and P2 after the plural sheets P1 and P2 have been delivered from the fixing unit 10. This feature is particularly useful in an image forming apparatus in which after a sheet has been delivered from the fixing unit 10, the transporting speed of the sheet becomes fast and the space between sheets varies.

The image forming apparatus may further have the driving part 5 for driving switching-on/off of the first curl correcting unit 3 and switching-on/off of the second curl correcting unit 4 at the same time, whereby the effects and advantages of the present invention become far more apparent.

In accordance with another aspect of the present invention, there is provided an image forming apparatus which has an image forming part for forming an image on the sheet Pl (P2) on the basis of input image information, a curling state detecting part 11 for detecting a state of curling which may occur on the sheet on which the image is formed by the image forming part, a first pressure part 12 for applying pressure to one surface of the sheet on which the image is formed by the image forming part, a second pressure part 13 for applying pressure to another surface of the sheet on which the image is formed by the image forming part, the second pressure part 13 being disposed downstream of the first pressure part 12, and the driving part 5 for driving the first pressure part 12 and the second pressure part 13 through an identical driving part on the basis of a result of a detection made by the curling state detecting part 11. The use of the identical driving part simplifies the structure of a mechanism section, and further, since the second pressure part 13 is arranged downstream of the first pressure part 12, curl correction can be performed on the trailing edge portion of the sheet in a direction to curve the sheet outward in the downward direction, whereby the accommodability of sheets can be improved.

In addition, the driving part 5 includes similar mechanism parts provided on both sides of the image forming apparatus in a direction perpendicular to a sheet transporting direction, and drives the first pressure part 12 and the second pressure part 13 through the mechanism parts provided on both sides. This feature is preferable in that curl correction can be performed in the direction perpendicular to the sheet transporting direction at the same time.

In addition, it is particularly preferable that the driving element in the driving part 5 have a cam mechanism, because the mechanism part can be simplified and the reliability of a mechanism can be increased.

Moreover, the cam mechanism is integrally provided with two cams which differ from each other in phase, and forms three modes for controlling the first pressure part 12 and the second pressure part 13 by using a single sensor and a single light blocking disk. This feature is preferable in that the size of the apparatus can be reduced and power consumption can be reduced, as compared with a method of determining the positions of the first and second pressure part 12 and 13 for each of the modes, as by a solenoid.

This cam mechanism forms three modes during one rotation of the two cams, and the three modes are a down-curl correction mode for correcting a curl in which the edge portions of a sheet are lowered, an up-curl correction mode for correcting a curl in which the edge portions of a sheet P are raised; and a curl non-correction mode which does not perform curl correction. This feature is preferable in that curl correction suited to the curl characteristics of sheets can be performed.

Moreover, the first pressure part 12 is provided with a first hard roll and a first soft roll facing the first hard roll and held by a rotatable first lever, while the second pressure part 13 is provided with a second hard roll and a second soft roll facing the second hard roll and held by a rotatable second lever.

In addition, it is preferable to position the rotational center of the first lever and the second lever at an approximately middle point of a line which connects the center of the first soft roll and the center of the second soft roll.

Moreover, the rotational center of the first lever and the second lever are positioned at an approximately middle point of a line which connects the center of the first hard roll and the center of the second hard roll. This feature is preferable in that a biting quantity can be uniformly controlled by rotating the first lever and the second lever through the same angle.

BRIEF DESCRIPTION OF THE DRAWINGS

Preferred embodiments of the present invention will be described in detail based on the drawings:

FIGS. 14(*a*), 14(*b*) and 14(*c*) are tables which show the patterns of decurler control during duplex printing in the first embodiment.

DESCRIPTION OF THE PREFERRED EMBODIMENTS

Preferred embodiments of the present invention will be described below in detail with reference to the accompanying drawings.

A first embodiment of the present invention will be described below.

Figure 1:
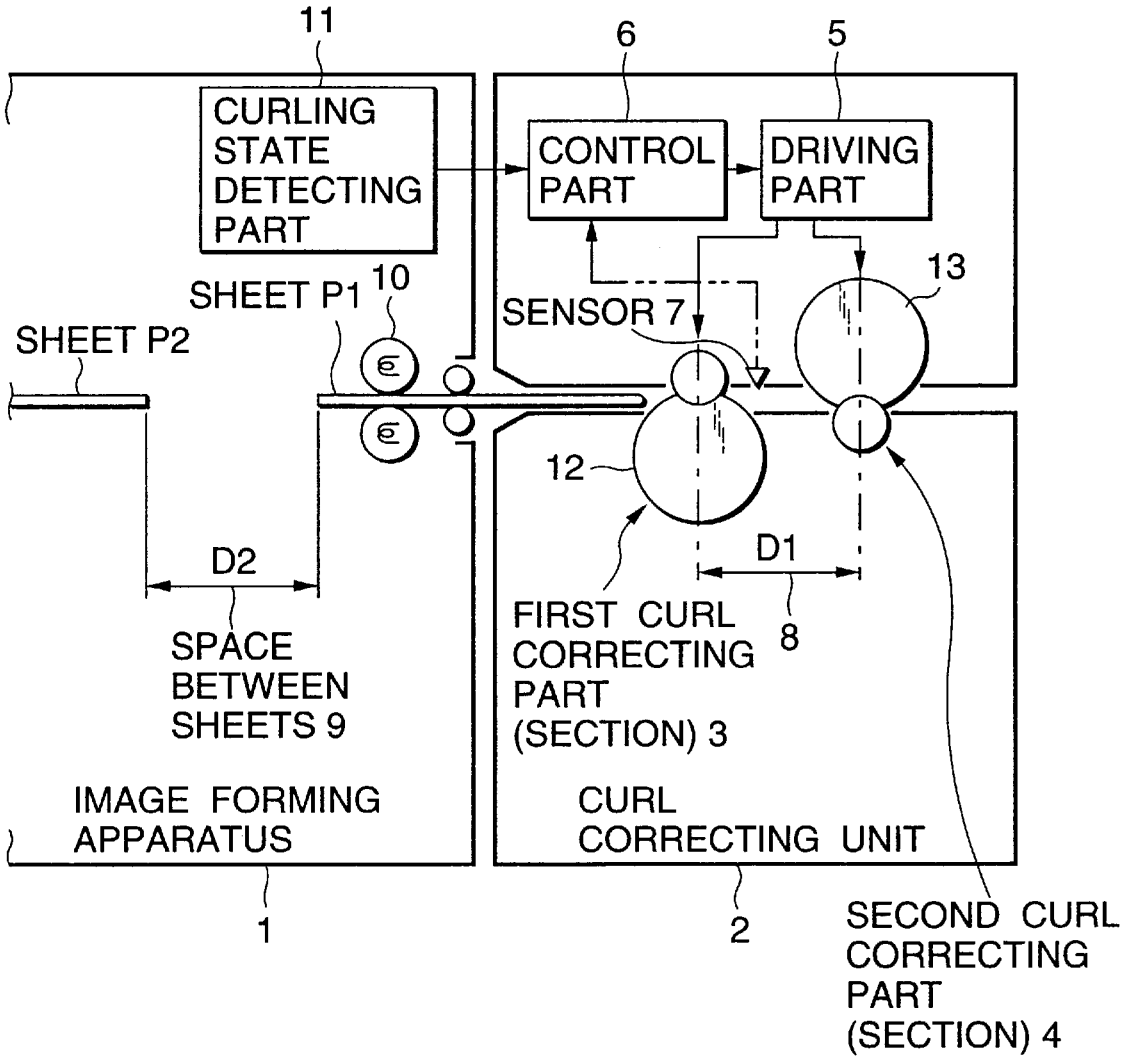
FIG. 1 is an explanatory view showing a curl correcting unit and an image forming apparatus according to the present invention.
Figure 2:
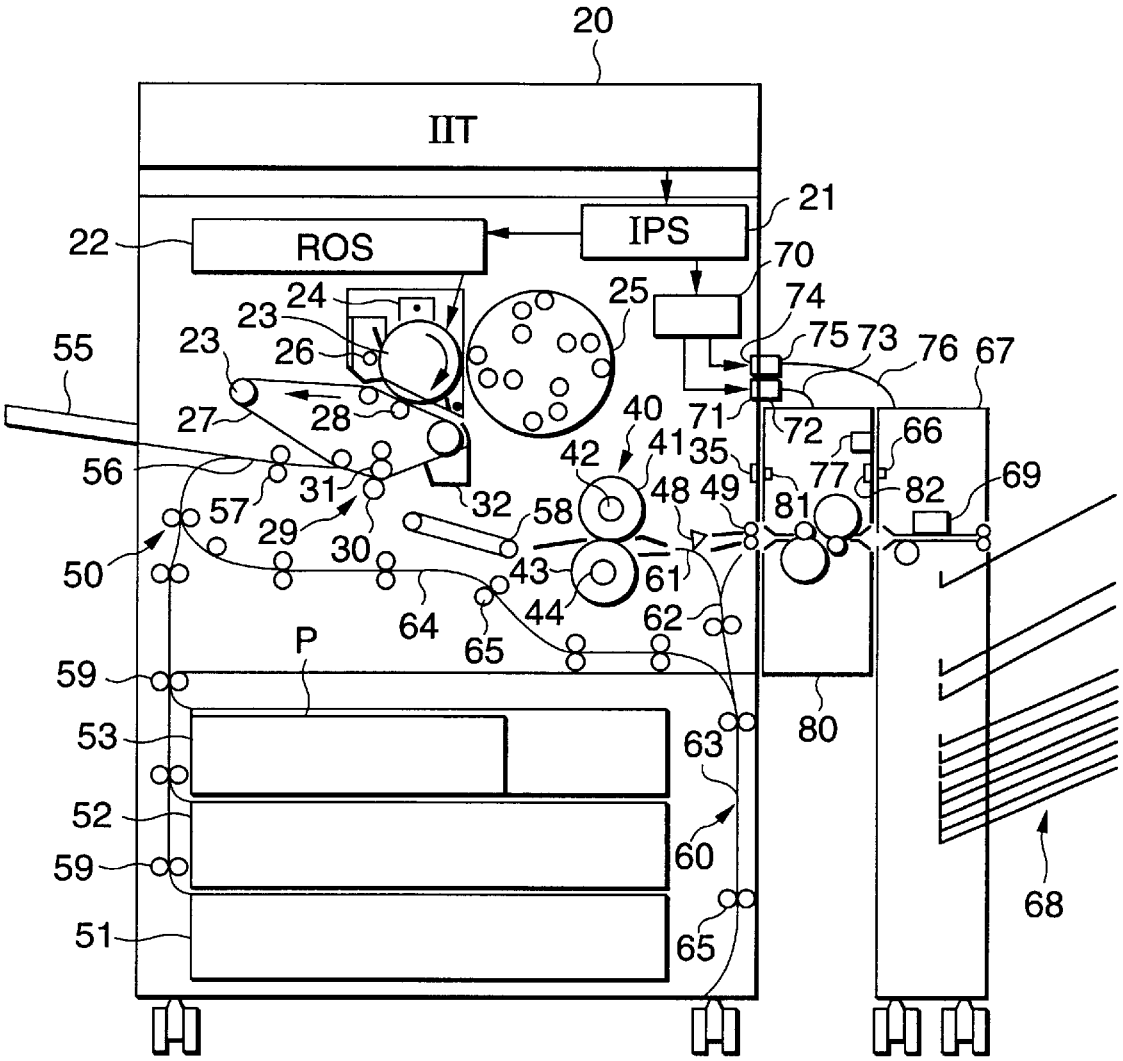
FIG. 2 is an explanatory view showing the diagrammatic construction of an image forming apparatus according to a first embodiment.

FIG. 2 diagrammatically shows the construction of an image forming apparatus (a color xerographic copying machine) according to the first embodiment of the present invention.

In the image forming apparatus shown in FIG. 2, a document reader (IIT) 20 focuses light reflected from a document illuminated with a lamp on a CCD by the use of an exposure optical system. This CCD converts the reflected light of a document image into an analog electrical signal for each of color component images of yellow (Y), magenta (M), cyan (C) and black (K), and the IIT 20 has the function of adjusting the gain of the analog electrical signal and converting the analog electrical signal into a digital signal, and performing shading correction.

An image processing unit (IPS) 21 applies data processing such as density correction, color conversion processing and enlargement/reduction to the image digital signal obtained from the IIT 20, and outputs the processed image digital signal to an image writing unit (ROS) 22 for each of the color components Y, M, C and K. The input signal to the IPS 21 is not limited to the output from the IIT 20, and executes similar data processing on image data to be inputted from externally connected equipment such as a personal computer.

A photoconductor drum (image carrier) 23 rotates in the direction indicated by, for example, the arrow shown on the photoconductor drum 23, and a charger 24 such as a corotoron electrically precharges the photoconductor drum 23.

The image writing unit (ROS) 22 such as a laser scanning unit writes the digital image inputted from the IPS 21 onto the photoconductor drum 23 as an electrostatic latent image. The image writing unit 22 illuminates the surface of the photoconductor drum 23 with a laser beam modulated by a laser driving signal generated for each color component.

A rotary developing unit 25 is provided with developing parts for the respective colors Y, M. C and K. and develops an electrostatic latent image formed on the photoconductor drum 23, by means of the corresponding one of the developing parts for the colors, thereby forming a toner image for each color component. Reference numeral 26 denotes a drum cleaner which removes residual toner from the photoconductor drum 23.

An intermediate transfer belt 27 is arranged in abutment with the surface of the photoconductor drum 23, and is passed around plural rolls (in the first embodiment, for example, five rolls) in such a manner an to rotate in the direction indicated by the arrow shown near the intermediate transfer belt 27.

A primary transfer unit (in the first embodiment, a transfer roll) 28 is disposed on the reverse side of the intermediate transfer belt 27 at a location where the intermediate transfer belt 27 faces the photoconductor drum 23. When a voltage of opposite polarity to the polarity of electrically charged toner is applied to the primary transfer unit 28, a toner image on the photoconductor drum 23 is electrostatically attracted to the intermediate transfer belt 27.

A secondary transfer unit 29 is disposed at a secondary transfer position where the intermediate transfer belt 27 faces a transporting path along which to transport a sheet P to used as a sheet. In the first embodiment, the secondary transfer unit 29 is provided with a secondary transfer roll 30 which is grounded and arranged in pressure contact with the toner image carrying side of the intermediate transfer belt 27, and a counter roll (backup roll) 31 which is arranged on the reverse side of the intermediate transfer belt 27 and constitutes a counter electrode for the secondary transfer roll 30. A bias of the same polarity as electrically charged toner is stably applied to the counter roll 31 via a power feeding roll.

Reference numeral 32 denotes a belt cleaner which removes residual toner from the intermediate transfer belt 27.

In the first embodiment, a fixing unit 40 is provided with a heating fixing roll 41 which has a heater 42 in its inside, and a pressure fixing roll 43 which is rotatably arranged in pressure contact with the heating fixing roll 41 within a predetermined nip range and has a heater 44 in its inside, and an exit sensor 48 for detecting whether the sheet P has passed the nip range is disposed on an exit side of the nip range of the fixing rolls 41 and 43.

Exit rolls 49 are formed of plural rolls each of which is partly enlarged in roll diameter, and serve to angle the sheet P fixed by the fixing unit 40 at a predetermined upward angle (in the first embodiment, about 15°) and also make the sheet P wavy in a sheet transporting direction to deliver the sheet P from the apparatus in the state of being wavy in the sheet transporting direction. These exit rolls 49 rotate so that their transporting speed becomes faster than that of the fixing unit 40. However, the exit rolls 49 have a torque limiter (not shown) for preventing the exit rolls 49 from impairing fixing performance, and are constructed to suppress the transporting speed until the sheet P passes through the fixing unit 40, and increase the transporting speed when the sheet P passes through the fixing unit 40.

In the first embodiment, a sheet transporting system 50 is constructed to transport paper through a predetermined paper path 56 from any of a predetermined number of (in the first embodiment, three) paper trays 51, 52 and 53 or from a manual paper feeding tray 55, transport the paper to the secondary transfer position at predetermined timing after temporarily stopping and registering the paper by means of registration rolls (regist rolls) 57 in the paper path 56, guide the sheet Passed through secondary transfer toward a transfer belt 58, and transport the paper to the fixing unit 40 by means of the transfer belt se. The paper path 56 has an adequate number of transporting rolls 59.

It is to be noted that the first embodiment has a paper returning transporting mechanism 60 which, when a duplex mode is selected, inverts paper which has been fixed on one side by the fixing unit 40 and returns the inverted paper to the secondary transfer position, or, even if an image needs only to be formed on one side of paper, can selectively invert the paper fixed by the fixing unit 40 and delivering the inverted paper from the apparatus.

In this paper returning transporting mechanism 60, a paper branch path 62 branches downward from a paper delivery path 61 which extends from the fixing unit 40, and a paper inverting path 63 extends downward from the paper branch path 62 and a paper returning path 64 which returns to the paper path 56 immediately before the secondary transfer position is provided in communication with the paper inverting path 63.

Each of the paper branch path 62, the paper inverting path 63 and the paper returning path 64 is provided with an adequate number of transporting rolls 65, and the transporting rolls 65 provided along the paper inverting path 63 are arranged to rotate back and forth at adequate timing.

A paper path switchover gate (not shown) is provided between each of the paper delivery path 61, the paper branch path 62, the paper inverting path 63 and the paper returning path 64 so that these paper paths are selectively switched over according to a selected mode.

If a one-side printed sheet P which has passed through the fixing unit 40 is to be delivered from the apparatus, the sheet P is delivered with an image printed on its top surface, i.e., in a so-called face-up state. The sheet P fixed by the fixing unit 40, after having been detected by the exit sensor 48, is delivered from the apparatus by the exit rolls 49. On the other hand, if a one-side printed sheet P which has passed through the fixing unit 40 is inverted by being passed through the paper delivery path 61 and the paper inverting path 63, and is delivered from the apparatus through the paper branch path 62 by the exit rolls 49, the sheet P is delivered with an image printed on its bottom surface, i.e., in a so-called face-down state.

A decurling unit 80 performs decurling on the sheet P which has been fixed by the fixing unit 40 and delivered by the exit rolls 49. The decurling unit 80 is positioned with respect to the body of the image forming apparatus by an approximately conically shaped pin connector portion 81 being fitted into a connecting hole 35 provided in the body of the image forming apparatus, and, after this positioning has been carried out, is secured to the body of the image forming apparatus by a magnet (not shown). A postprocessing unit 67 is constructed to execute postprocessing on the paper delivered from the decurling unit 80, and is provided with devices such as a sorter 68 for distributing the paper as a required number of prints and a punch 69 for punching the paper. The postprocessing unit 67 has a pin connector portion 66 having an approximately conical shape similar to that the decurling unit have the pin connector portion 81, and when the pin connector portion 66 is fitted into a connecting hole 82 of the decurling unit 80, the postprocessing Unit 67 is positioned with respect to the decurling unit 80.

A control unit 70 not only exerts control over sheet transportation, but also exerts control over the adjustment of a curl correction quantity of the decurling unit 90, the operation of the postprocessing unit 67 and the like on the basis of an image output signal from the IPS 21 after having recognized that the decurling unit 80 and the postprocessing unit 67 are connected to the body of the image forming apparatus.

Moreover, the control unit 70 recognizes the sheet size of a sheet P which is fed from any of the paper trays 51, 52 and 53 and the manual paper feeding tray 55, and also recognizes the humidity conditions under which the image forming apparatus is placed and the humidity of the inside of each of the paper trays 51, 52 and 53, and performs adjustment of a curling quantity in the decurling unit 80.

A control signal for the decurling unit 80 which is outputted from the control unit 70 passes through a decurling-unit-side connector 72 connected to a connector 71 provided on the body of the image forming apparatus, and is transmitted to the decurling unit 80 via a cable 73. On the other hand, a control signal for the postprocessing unit 67 which is outputted from the control unit 70 passes through a postprocessing-unit-side connector 75 connected to a connector 74 provided on the body of the image forming apparatus, and is transmitted to the postprocessing unit 67 via a cable 76.

The decurling unit 80 has a connector 77 connectable to the postprocessing-unit-side connector 75, and the control signal for the postprocessing unit 67 from the control unit 70 can be transmitted to the postprocessing unit 67 via the connector 77. At this time, the control signal for the postprocessing unit 67 can also be transmitted to the postprocessing unit 67 via the connector 71, the decurling-unit-side connector 72 and the cable 73.

Figure 3:
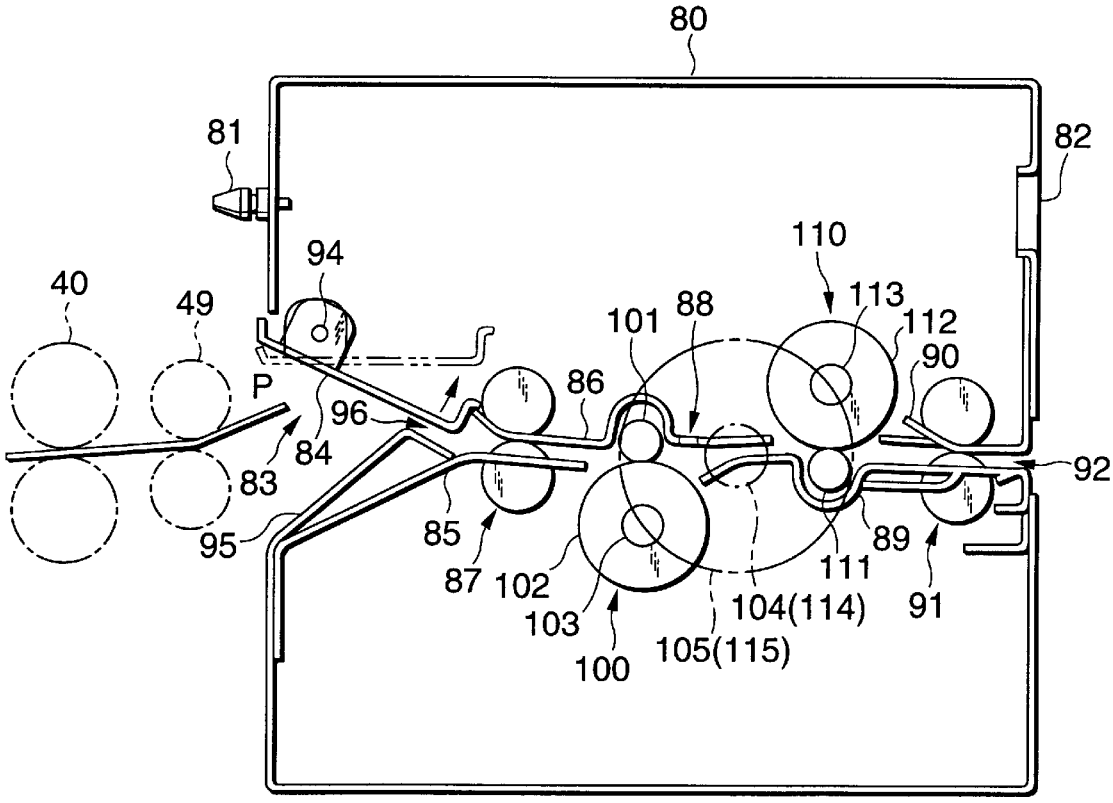
FIG. 3 is an explanatory view showing the diagrammatic construction of a decurling unit used in the first embodiment.

The construction of the decurling unit 80 used in the first embodiment will be described below with reference to FIG. 3.

The decurling unit 80 has a receiving port 83 through which to receive a sheet P which has been fixed by the fixing unit 40 in the body of the image forming apparatus and delivered from the exit rolls 49 at a constant angle. This receiving port 83 has an entrance upper guide 84 for guiding the leading edge of the sheet P delivered at the constant angle.

A straitening guide 95 has a straightening portion 96 which is tapered toward its leading end. The straitening guide 95 removes a wavy shape which is formed on a leading edge portion of the sheet P delivered from the exit rolls 49 as viewed in the sheet transporting, direction, by means of the straightening portion 96.

An entrance roll 87 guides the sheet P delivered from the body of the image forming apparatus, to the inside of the decurling unit 90, and also transports the sheet P released from the fixing unit 40 of the body of the image forming apparatus, at an increased speed. Although the rotational timing of the entrance roll 87 needs to be adjusted so as not to forcedly pull the sheet P out of the fixing unit 40, it is in general difficult to completely adjust the timing of sheet transportation with the entrance roll 87. For this reason, in the first embodiment, the entrance upper guide 84 is constructed to be lifted upward (in the direction indicated by the arrow shown near the entrance upper guide 84) about a pivot 94, and the transportation delay of the sheet P is absorbed by this upward lift immediately before the entrance roll 87.

A first lower guide 85 for guiding the sheet P which is entering the decurling unit 80 guides the sheet P toward each decurler in cooperation with an intermediate upper guide 86.

A first decurler 100 executes decurling by pressing the sheet P from below the first lower guide 85, and has a driving roll 101 which is a hard roll for transporting the sheet P, and a pressure roll 102 which is a soft roll against which the driving roll 101 is to be elastically pressed to effect curl correction. When the sheet P enters the first decurler 100, the pressure roll 102 is elastically pressed against the driving roll 101 so that the first decurler 100 deforms the sheet P by means of the arc of the driving roll 101 at the clamping position between the pressure roll 102 and the driving roll 101. Thus, the first decurler 100 forms a downward curve in the sheet P by elastically pressing the pressure roll 102 against the driving roll 101, thereby effecting curl correction in a direction in which the sheet P is to be curved downward (the leading edge portion of the sheet P is to be raised).

A shaft 103 is located at the center of the pressure roll 102, and is made to move while drawing an arc 105 centered at a rotating shaft 104, by a first link (to be described later) The amount in which the pressure roll 102 is elastically pressed against the driving roll 101 varies with the movement of the shaft 103.

A sensor 88 detects the sheet P which has passed through the first decurler 100, and a second decurler 110 executes decurling by pressing the sheet P from above the intermediate upper guide 86.

The second decurler 110 has a driving roll 111 which is a hard roll for transporting the sheet P, and a pressure roll 112 which is a soft roll against which the driving roll 111 is to be elastically pressed to effect curl correction. When the sheet P enters the second decurler 110, the pressure roll 112 is elastically pressed against the driving roll 111 so that the second decurler 110 deforms the sheet P by means of the arc of the driving roll 111 at the clamping position between the pressure roll 112 and the driving roll 111, thereby forming an upward curve On the sheet P. Thus, the second decurler 110 effects curl correction in a direction in which the sheet P is to be curved upward (the leading edge portion of the sheet P is to be lowered).

A shaft 113 is located at the center of the pressure roll 112, and is made to moveby a second link (to be described later) while drawing an arc 115 similar to the arc 105 used in the first decurler 100, about a rotating shaft 114 having the same center as the rotating shaft 104 used in the first decurler 100. The amount in which the pressure roll 112 is elastically pressed against the driving roll 111 varies with the movement of the shaft 113.

In the first embodiment, the sheet transporting speed of the body of the image forming apparatus varies among 60, 130, 220 and 350 mm/sec, and the decurling unit 80 is designed to cope with this variation. In the first embodiment, the space between the first decurler 100 and the second decurler 110 is designed to be 35 mm which is smaller than 38.5 to 135 mm which is the space between sheets of paper which are continuously fed in the image forming apparatus used in the first embodiment. Since the first decurler 100 and the second decurler 110 are spaced part from each other by a space smaller than the space between sheets, different sheets are prevented from concurrently coming into contact with the sheet contact portions of the respective first and second decurlers 100 and 110, whereby even if a driving part common to both decurlers is used, curl correction can be appropriately executed. Moreover, since the second decurler 110 is provided downstream of the first decurler 100, even if the space between sheets is extremely small and close to the space between the first decurler 100 and the second decurler 110 the decurlers cannot be switched over in time, curl correction can be reliably executed without impairing the accommodatability of sheets, if curl correction in a direction to lower the edge portions of a sheet is needed.

In the first embodiment, SUS of Φ8 is used for each of the driving rolls 101 and 111 which are hard rolls. It is desirable that a roll having the smallest possible diameter be adopted as each of the driving rolls 101 and 111 so that its decurling function can be enhanced, but in the first embodiment a roll of Φ8 is adopted in terms of the deflection of a shaft. A urethane material of Φ26 (20 lb/ft$^3$) is used for each of the pressure rolls 102 and 112 which are soft rolls, so that the pressure rolls 102 and 112 are imparted constant elasticity which enables the pressure rolls 102 and 112 to be elastically pressed against the respective driving rolls 101 and 111.

A second lower guide 89 and an exit upper guide 90 guide the sheet P which has passed through each of the first decurler 100 and the second decurler 110, to a delivery roll 91, and the delivery roll 9l gives transporting force to the sheet P, thereby transporting the sheet P to the postprocessing unit 67 from exit 92.

As described previously, the pin connector portion 81 serves to position the decurling unit 80 by being fitted into the connecting hole 35 of the body of the image forming apparatus, and the pin connector portion 66 of the postprocessing unit 67 is fitted into the connecting hole 82.

A construction which drives the first decurler 100 in the first embodiment of the present invention will be described below with reference to FIG. 4.

Figure 4:
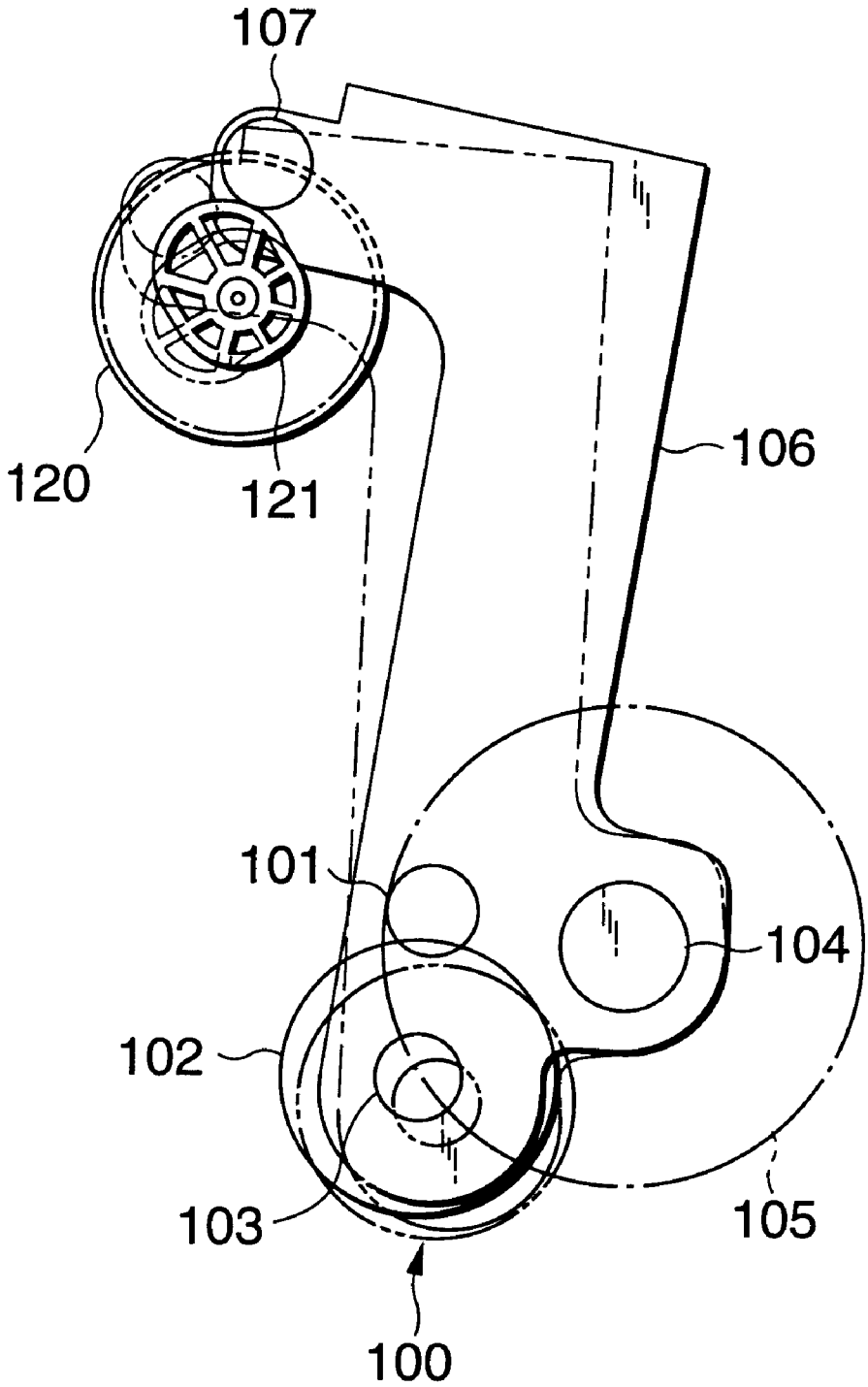
FIG. 4 is an explanatory view illustrating a driving system for a first decurler in the first embodiment.

Referring to FIG. 4, a first lever 106 for moving the pressure roll 102 in the first decurler 100 has a first roller 107 which is in contact with a cam surface 121, and rotates about the rotating shaft 104. An integrated cam 120 for moving the first lever 106 has the cam surface 121 which is kept in contact with the first roller 107 to actually move the first lever 106. The integrated cam 120 receives a signal from the control unit 70 and determines its cam position by means of a motor which will be described later as well as the on/off operation of a solenoid clutch. In accordance with the determined cam position, the first roller 107 causes the fast lever 106 to rotate about the rotating shaft 104, thereby moving the shaft 103 and elastically pressing the pressure roll 102 against the driving roll 101. Incidentally, the integrated cam 120 causes a second lever (to be described later) of the second decurler 110 to rotate at the same time as the first lever 106.

In the first embodiment, mechanisms which have the same dimensions as the mechanism shown in FIG. 4 and are symmetric with respect to each other are provided on opposite sides (on the visible side and the opposite invisible side of the apparatus) as viewed in a direction perpendicular to the sheet transporting direction, and the pressure roll 102 is moved on both the visible side and the opposite invisible side of the apparatus. Accordingly, pressure can be uniformly applied to the pressure roll 102 on both the visible side and the opposite invisible side of the apparatus as viewed in the direction perpendicular to the sheet transporting direction, whereby stable curl correction can be applied to the sheet P.

A construction which drives the second decurler 110 in the first embodiment of the present invention will be described below with reference to FIG. 5.

Figure 5:
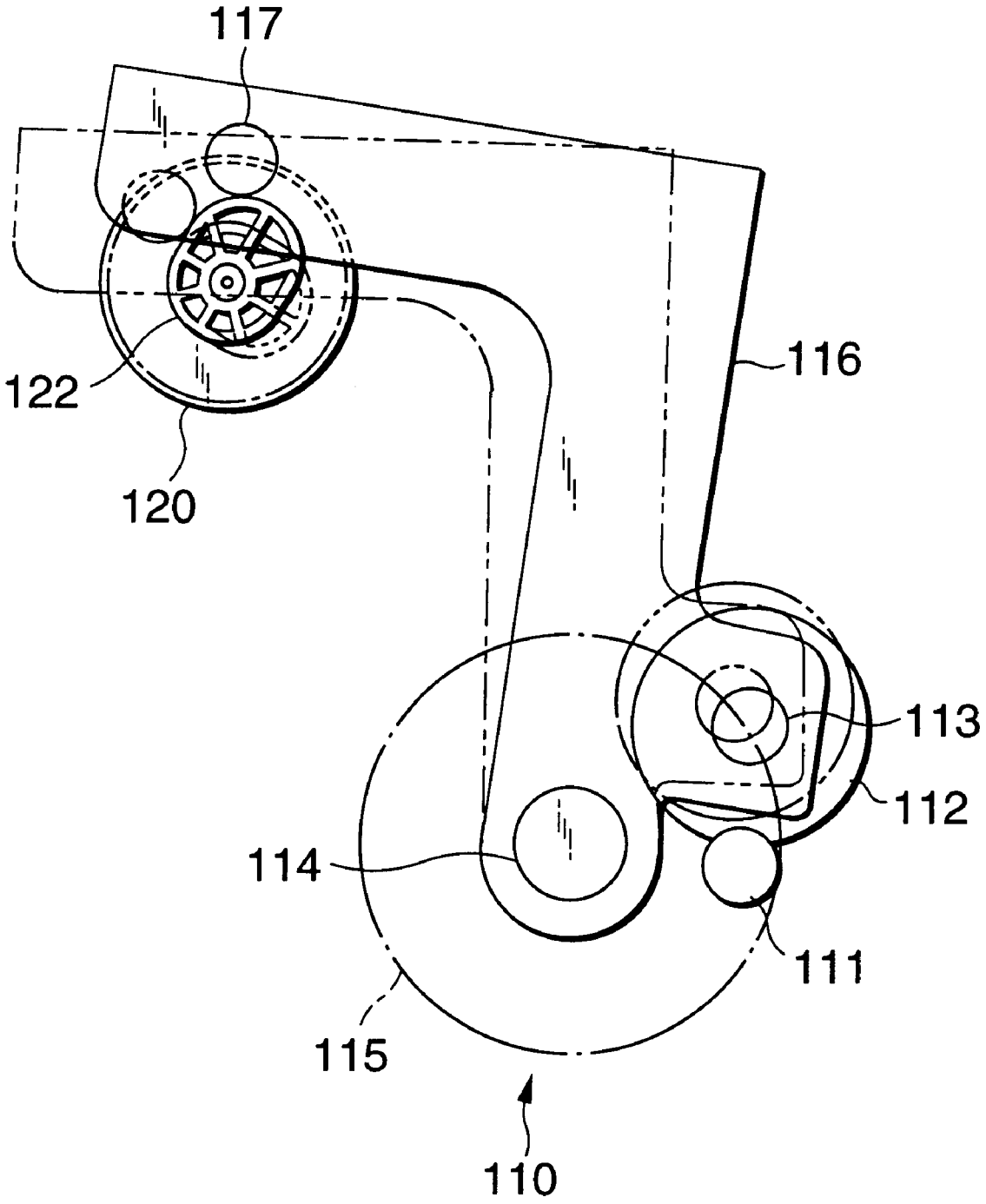
FIG. 5 is an explanatory view illustrating a driving system for a second decurler in the first embodiment.

Referring to FIG. 5, a second lever 116 for moving the pressure roll 112 in the second decurler 110 has a second roller 117 which is in contact with a cam surface 122, and rotates about the rotating shaft 114. The integrated cam 120 has the cam surface 122 which is kept in contact with the second roller 117 to actually move the second lever 116. As described previously, the integrated cam 120 receives a signal from the control unit 70 and determines its cam position by means of the motor which will be described later as well as the on/off operation of the solenoid clutch. In accordance with the determined cam position, the second roller 117 causes the second lever 116 to rotate about the rotating shaft 114, thereby moving the shaft 113 and determining an amount by which elastically press the pressure roll 112 against the driving roll 111. In the first embodiment, with the rotation of the integrated cam 120, the first lever 106 of the first decurler 100 and the second lever 116 of the second decurler 110 are moved at the same time, and the cam surface 122 is formed on the integrated cam 120 integral with the cam surface 121, in the state of being 120° out of phase with the cam surface 121 used in the first decurler 100.

In the first embodiment, similarly to the pressure roll 102 used in the first decurler 100, the pressure roll 112 is moved by similar mechanisms which are provided on the visible side and the opposite invisible side of the apparatus as viewed in a direction perpendicular to the sheet transporting direction.

Figure 6:
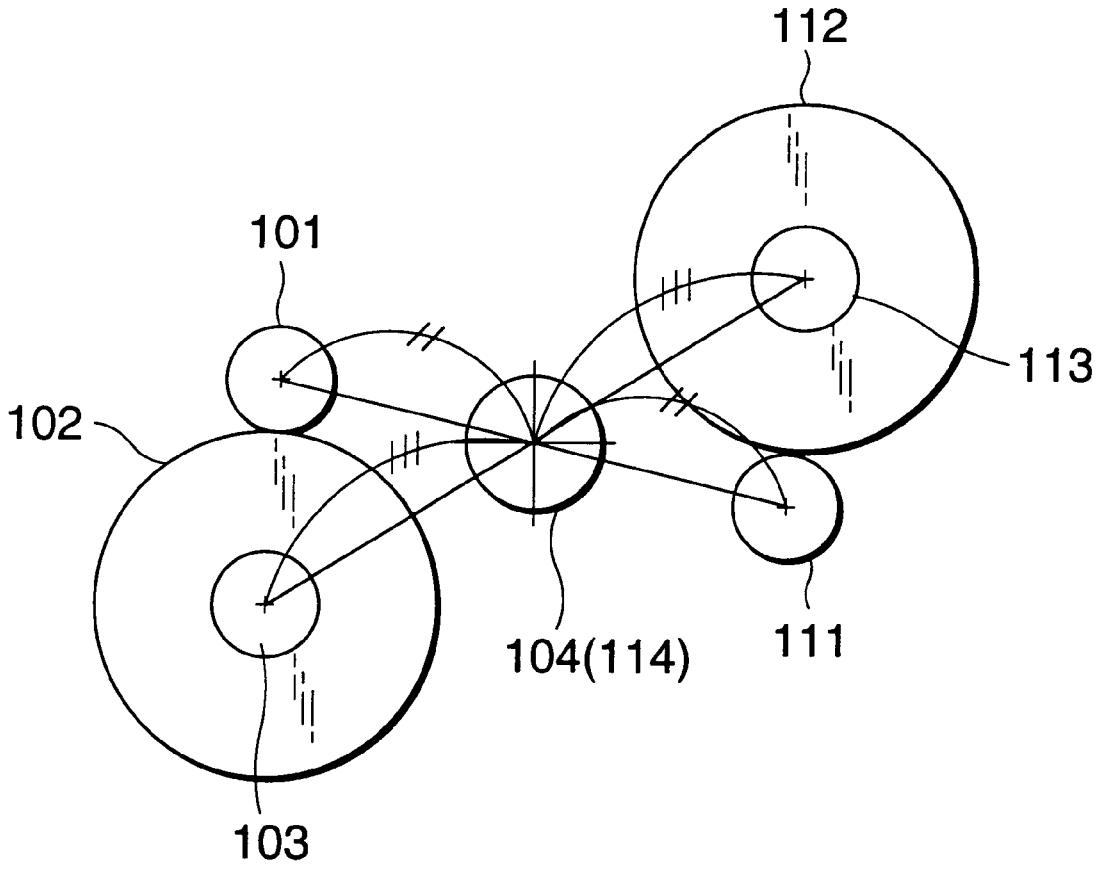
FIG. 6 is an explanatory view showing the relationship between the rotational positions of levers.

FIG. 6 is a view illustrating the position of the rotational center of the rotating shaft 104 of the first lever 106 and the position of the rotational center of the rotating shaft 114 of the second lever 116.

The rotational center of the rotating shaft 104 (114) is arranged to coincide with the middle point of a line which connects the centers of the respective pressure rolls 102 and 112 which are soft rolls. Moreover, this rotational center is arranged to coincide with the middle point of a line which connects the centers of the respective driving rolls 101 and 111 which are hard rolls.

By rotating the first lever 106 and the second lever 116 by the same angle with respect to the rotational center, it is possible to uniformly control the amounts by which to elastically press the respective pressure rolls 102 and 112 against the driving rolls 101 and 111. In addition, since rotating members such as the first lever 106 and the second lever 116 can be gathered at one location, the entire size of the apparatus can be reduced.

The first embodiment is constructed to be able to have three modes by using the first decurler loo and the second decurler 110. The three modes are; a down-curl correction mode for strongly pressing the pressure roll 102 of the first decurler 100 to correct a down curl of an edge portion of the sheet P; an up-curl correction mode for strongly pressing the pressure roll 112 of the second decurler 110 to correct an up curl of an edge portion of the sheet P; and a curl non-correction mode which does not strongly press either of the pressure rolls 102 and 112 of the respective first decurlers 100 and 110, because the sheet P is not curled.

Figure 7:
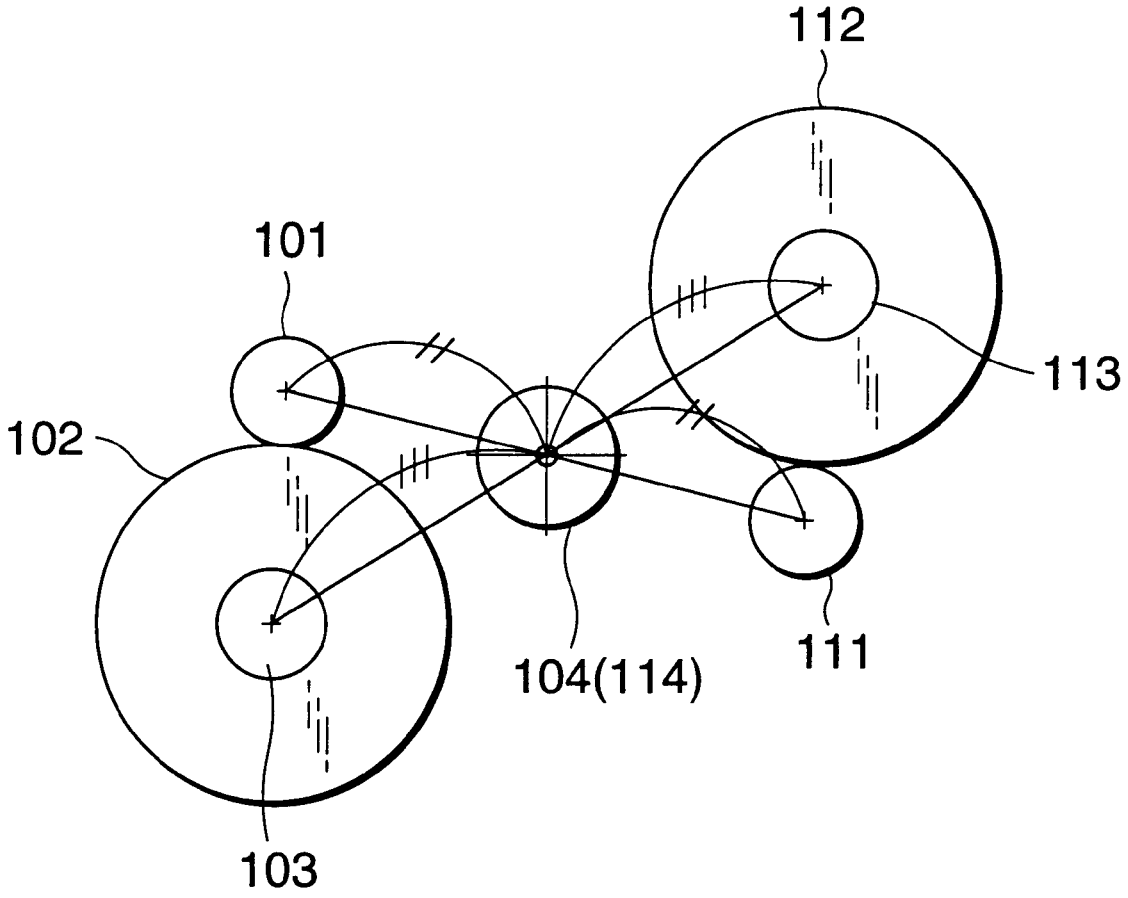
FIG. 7 is an explanatory view illustrating a general method for defining stop positions.

In general, as means to be normally used for determining three different stop positions according to the three modes, it has been considered to use means for defining such three stop positions in accordance with the combination of three photosensors and one light blocking disk as shown in FIG. 7, and the three modes can be selectively determined during one rotation of the light blocking disk. However, this method needs to use three photosensors and hence a complicated construction, and incurs an increase in cost.

The first embodiment solves these problems by controlling the three stop positions by the combination of one photosensor and one light blocking disk.

Figure 8:
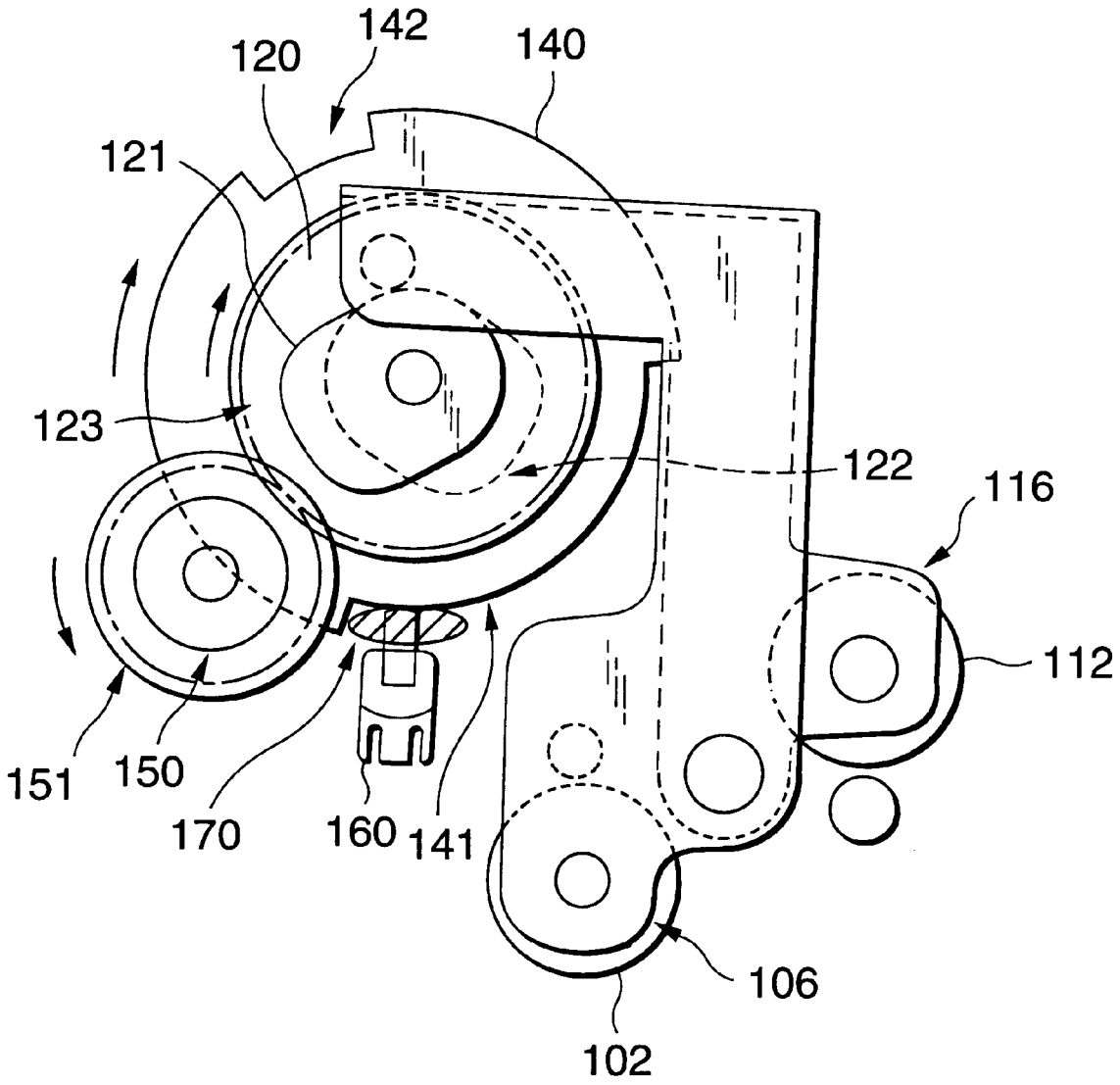
FIG. 8 is an explanatory view illustrating the manner of driving in a curl non-correction mode in the first embodiment.
Figure 9:
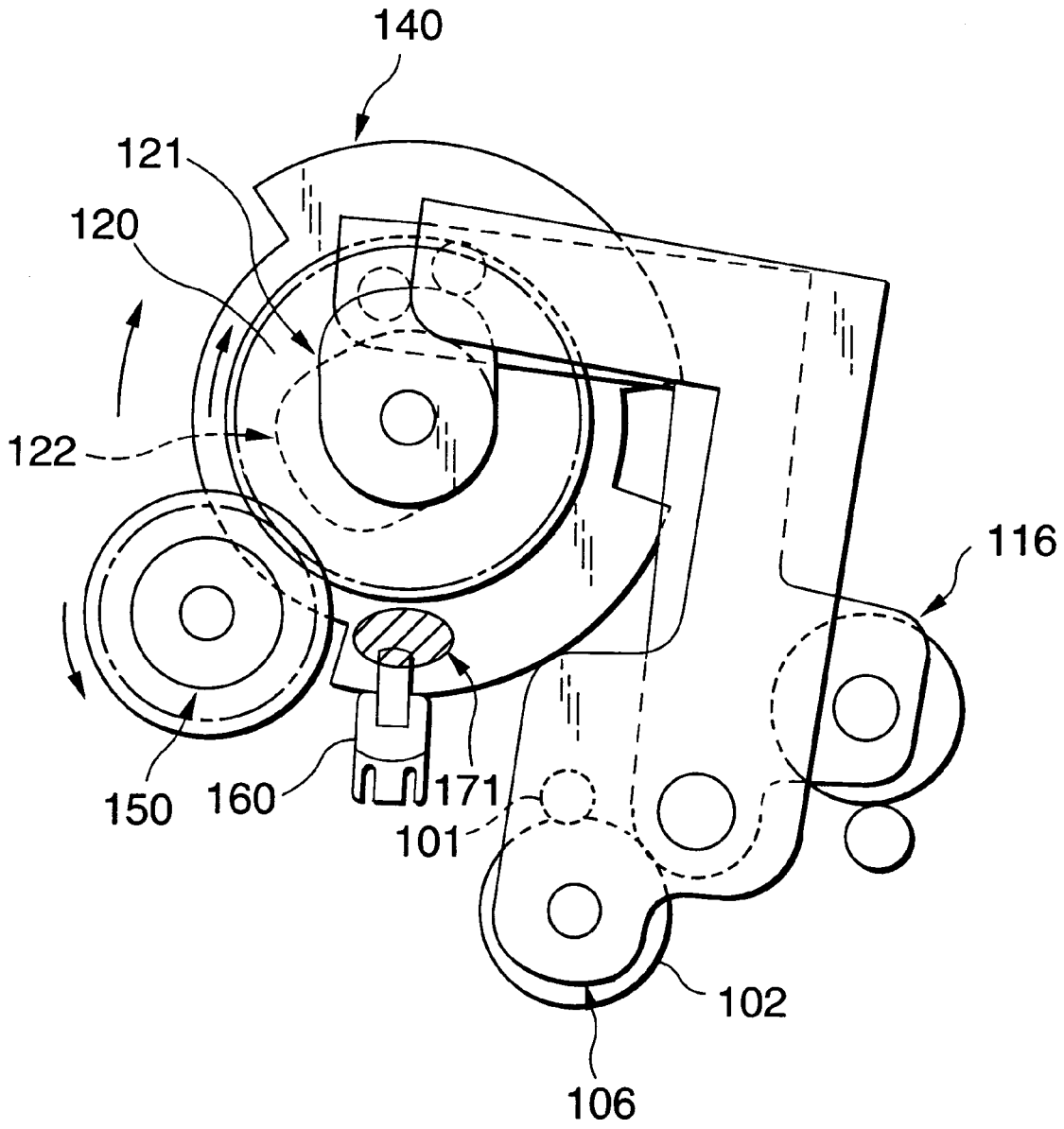
FIG. 9 is an explanatory view illustrating the manner of driving in a down-curl correction mode in the first embodiment.
Figure 10:
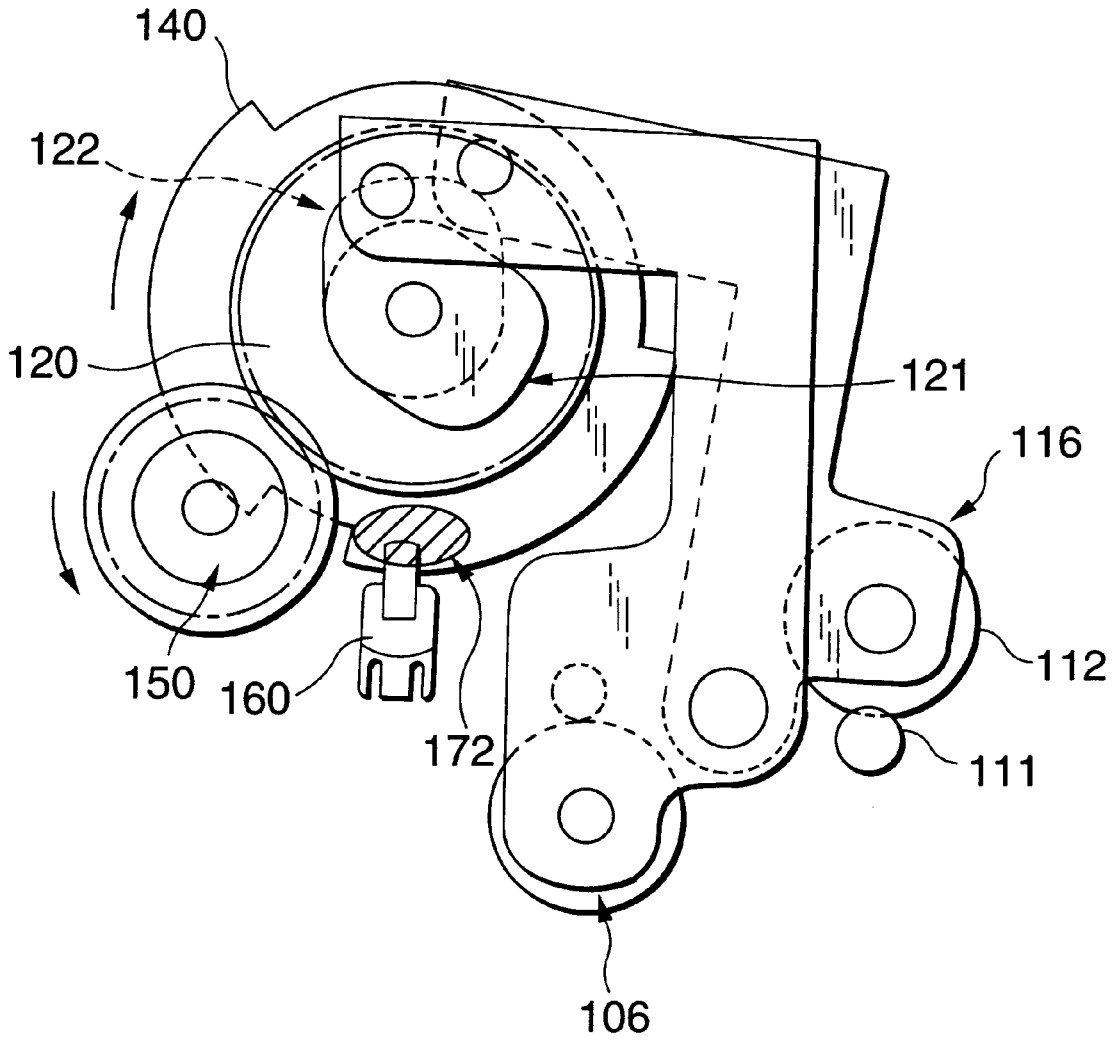
FIG. 10 is an explanatory view illustrating the manner of driving in an up-curl correction mode in the first embodiment.

FIGS. 8 to 10 are views illustrating the contents of switchover of the three modes using the first decurler 100 and the second decurler 110 in the first embodiment, as well as an operating mechanism for switchover of the three modes. In the mechanism shown in FIGS. 8 to 10, a light blocking disk 140 has a large slit 141 and a small slit 142, and rotates integrally with the integrated cam 120. The integrated cam 120 is integrally formed of the cam surfaces 121 and 122 which are 120° out of phase with each other, as well as a gear 123, and the cam surfaces 121 and 122 and the gear 123 rotate in synchronism with each other. A solenoid clutch 150 is integrated with a gear 151 which receives driving from a motor (not shown) and transmits driving force to the gear 123 formed on the integrated cam 120. A photosensor 160 detects the large slit 141 and the small slit 142 formed in the light blocking disk 140.

The reason why the cam surfaces 121 and 122 are 120° out of phase with each other is to prepare three positions having different roles during one rotation of the integrated cam 120.

The motor (not shown) may be arbitrarily selected from among a sheet transporting motor of the decurling unit 80, a motor for transporting a sheet in the body of the image forming apparatus, a motor of the postprocessing unit 67 connected to the decurling unit 80, and the like.

Referring to FIG. 8, first of all, when the power supply of the body of the image forming apparatus is turned on, the aforesaid motor is activated to turn on the solenoid clutch 150 and rotate the integrated cam 120 and the light blocking disk 140. When the rotational position of the integrated cam 120 reaches a stop position 170 where the phocosensor 160 is first turned off after the small slit 142 of the light blocking disk 140 has passed through the photosensor 160, the solenoid clutch 150 is turned off to stop the rotation of the integrated cam 120 and the light blocking disk 140, and the motor is stopped last. When the integrated cam 120 is at the stop position 170, the cam surfaces 121 and 122 do not press up the first lever 106 and the second lever 116 so that the decurling unit 80 is set to the curl non-correction mode. Thus, when the power supply is turned on, the integrated cam 120 is automatically set to the stop position 170, i.e., the decurling unit 80 is automatically set to the curl non-correction mode.

If a sheet P transported by the control unit 70 is in a down-curled state where the leading and trailing edge portions of the sheet P are curled downward, the decurling unit 80 is switched from the curl non-correction mode to the down-curl correction mode shown in FIG. 9.

When the decurling unit 80 is to be switched to the down-curl correction mode, the motor is again activated to turn the solenoid clutch 150 and rotate the integrated cam 120 and the light blocking disk 140. When the rotational position of the integrated cam 120 reaches a stop position 171 where the photosensor 160 is first turned on, the solenoid clutch 150 is turned off to stop the rotation of the integrated cam 120 and the light blocking disk 140. When the integrated cam 120 is at the stop position 171, the cam surface 121 of the intergrated cam 120 presses up the first lever 106, while the cam surface 122 of the integrated cam 120 does not press up the second lever 116, so that the decurling unit 80 is set to the down-curl correction mode. Thus, the decurling unit 80 is switched from the above-described curl non-correction mode to the down-curl correction mods.

If a sheet P transported by the control unit 70 is in an up-curled state where the leading and trailing edge portions of the sheet P are curled upward, the decurling unit 80 is switched from the curl non-correction mode to the up-curl correction mode shown in FIG. 10.

When the decurling unit 80 is to be switched to the up-curl correction mode, the solenoid clutch 150 is not turned off when the rotational position of the integrated cam 120 reaches the stop position 171 (FIG. 9) where the photosensor 160 is first turned on, and when the rotational position of the integrated cam 120 reaches a stop position 172 where the photosensor 160 is turned on at the second time, the solenoid clutch 150 is turned off to stop the rotation of the integrated cam 120 and the light blocking disk 140. When the integrated cam 120 is at the stop position 172, the cam surface 121 does not press up the first lever 106, while the cam surface 122 presses up the second lever 116, so that the decurling unit 80 is met to the up-curl correction mode. Thus, the decurling unit 80 is switched from the curl non-correction mode to the up-curl correction mode.

After the sheet P has been fed out of the decurling unit 80, the solenoid clutch 150 is again turned on to rotate the integrated cam 120 and the light blocking disk 140 in order to restore the decurling unit 80 from the down-curl correction mode or the up-curl correction mode to the curl non-correction mode. At this time, when the rotational position of the integrated cam 120 reaches the stop position 170 (FIG. 9) where the photosensor 160 is first turned off after the small slit 142 of the light blocking disk 140 has passed through the photosensor 160, the solenoid clutch 150 is turned off to stop the rotation of the integrated cam 120 and the light blocking disk 140, and the motor is stopped last.

In the above-described manner, in the first embodiment, the three stop positions can be defined by the combination of one photosensor and one light blocking disk. Accordingly, since electric power other than that required for sheet transportation is not needed after the integrated cam 120 has been switched to any of the stop positions, the first embodiment has the great merit of reducing the size and the cost of the apparatus as well as the power consumption thereof, as compared with a conventional construction (for example, Japanese Patent Laid-Open No. 48343/1981) which defines each stop position by pressing individual pressure rolls against the corresponding driving rolls by means of solenoids and the like while consuming electric power at all times.

The first embodiment is designed so that when curl correction is on, the pressure rolls 102 and 112 are elastically pressed against the respective driving rolls 101 and 111 in such a manner that the respective driving rolls 101 and 111 bite into the pressure rolls 102 and 112 by about 2 mm. This is because a biting quantity of about 2 mm is needed for curl correction with respect to an image having an image density of about 150% (the theoretical maximum density of four colors Y, M, C and K is 400%). On the other hand, when curl correction is off, the pressure rolls 102 and 112 are elastically pressed against the respective driving rolls 101 and 111 in such a manner that the respective driving rolls 101 and lll are allowed to bite into the pressure rolls 102 and 112 by about 0.5 mm without completely preventing the respective driving rolls 101 and 111 from biting into the pressure rolls 102 and 112. This is because the minimum transporting force required to transport the sheet P to the next step can be retained and because an up curl can be prevented at the trailing edge portion of the sheet P to improve the accommodability of sheets to a further extent, by applying pressure to the sheet P at all times in the second decurler 110 located on the downstream side which has a strongest influence on curl correction.

In the first embodiment, although the biting quantities in the first decurler 100 and the second decurler 110 are made nearly equal, the shape of the cam surface 122, the second lever 116 and the like can also be modified to increase the biting quantity in the second decurler 110 to a small extent so that the accommodability of sheets is increased.

In the first embodiment, the pressure rolls 102 and 112 slide, but the driving rolls 101 and 111 do not slide. This construction takes account of a case in which if the driving rolls 101 and 111 are made to slide, a sheet transporting pass may change and disable appropriate sheet transportation.

Control of a curl correction quantity to be carried out by the control unit 70 in the first embodiment will be described below with reference to FIGS. 11 to 14.

Figure 11:
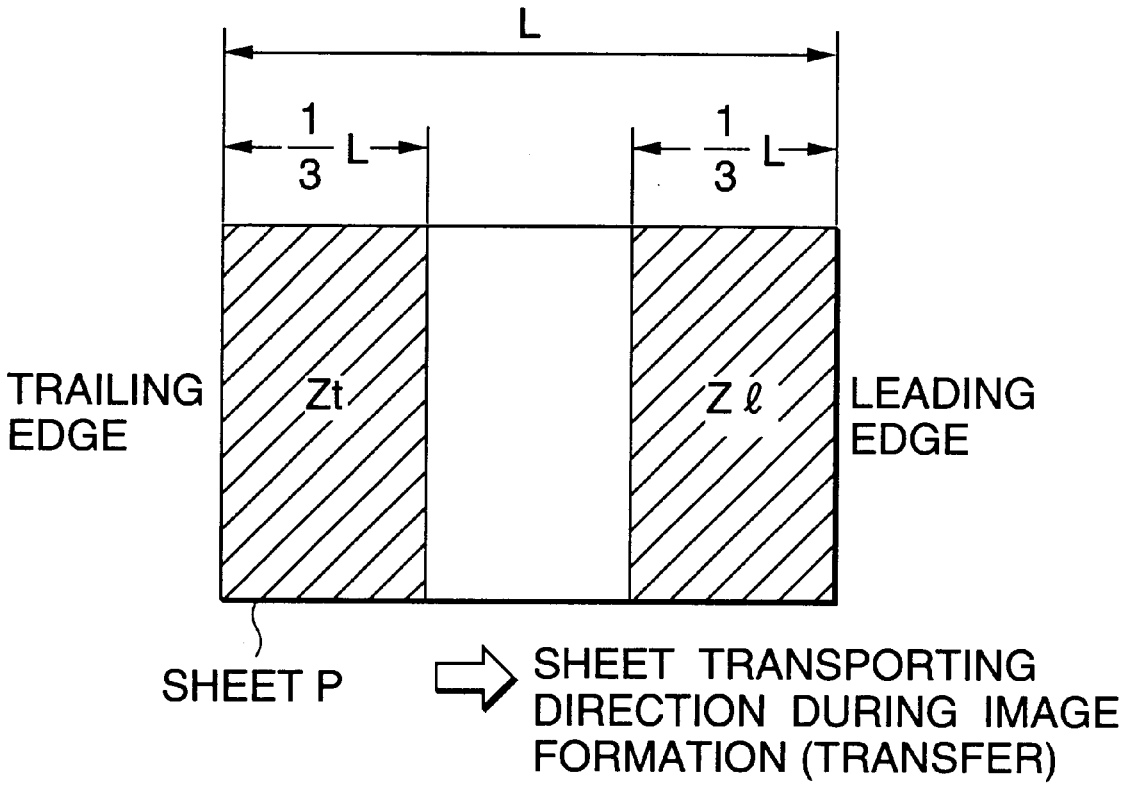
FIG. 11 is an explanatory view of the detection of an image content in the first embodiment.

FIG. 11 is an explanatory view of the processing of designating a particular area of an image, detecting an image content (the quantity of toner) and predicting the occurrence of a curl. In the first embodiment, because the manner of a curl varies according to the difference between image contents transferred to sheets, prediction of a curl quantity is made by measuring information transmitted from the IPS 21, for example, an image content obtained by reading from a document by the IIT 20 or an image content sent from a host. In this case, because an image content at an edge portion of a sheet greatly contributes to the occurrence of a curl, the first embodiment is constructed to detect, for example, the image content in an image area Z1 which occupies the leading 1/3L area of a sheet of length L as viewed in the sheet transporting direction during image formation (transfer), and the image content in an image area Zt which occupies the trailing 1/3L area of the sheet as viewed in the same direction during image formation (transfer), and predict a curling direction on the basis of the difference between the image contents in the respective image areas Zl and Zt.

Figures 12, 13:
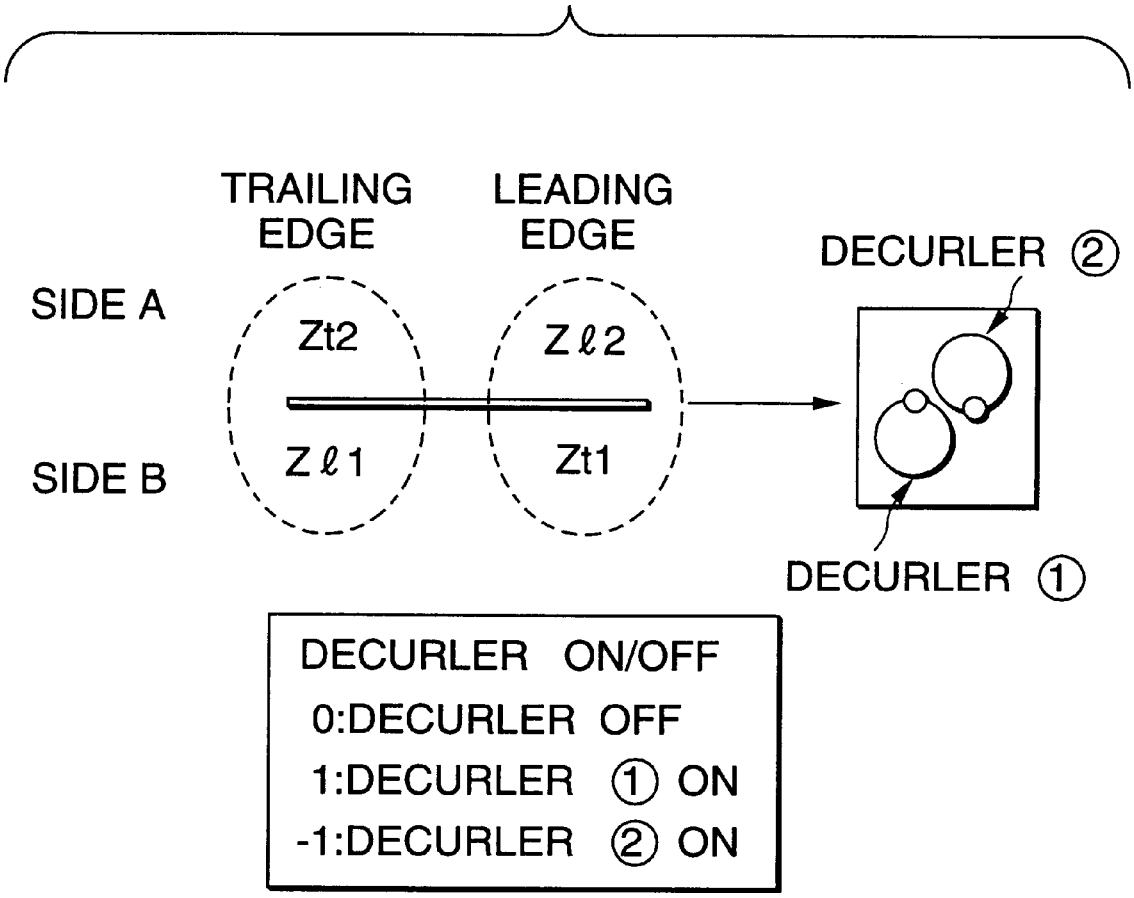
FIG. 12 is an explanatory view illustrating the relationship between switching-on/off of each of the decurlers and sheet surfaces in the first embodiment.
FIG. 13 is an explanatory view of the definitions of the terms used in the first embodiment.
Figure 15A:
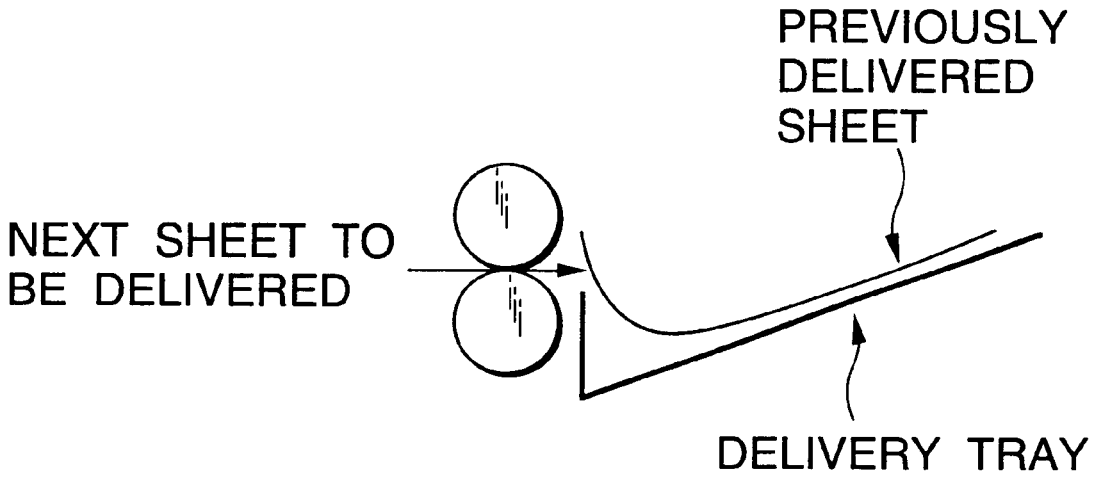
FIGS. 15(*a*) and 15(*b*) are schematic explanatory views siding in explaining a problem to be solved by the present invention.
Figure 15B:
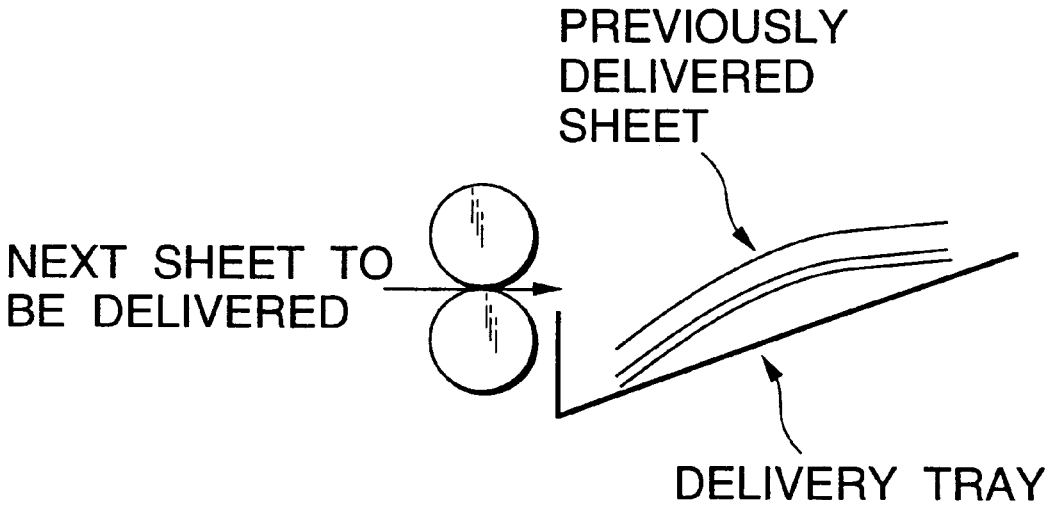

FIG. 12 is an explanatory view of the relationship between switching-on/off of each of the decurlers and sheet surfaces.

For the convenience of the following description, the first decurler 100 and the second decurler 110 of the decurling unit 80 are called a decurler (1) and a decurler (2), respectively. In FIG. 12, the state in which both decurlers are off is expressed as a state "0", the state in which the decurler (1) is on is expressed as a state "1", and the state in which the decurler (2) is on is expressed as a state "1".

The side A of a sheet corresponds to the upper side of the decurling unit 80 and the side B of the sheet corresponds to the lower side of the decurling unit 80. In the first embodiment, it is possible to achieve duplex printing, and, even in the case of simple printing, it is possible to select a face-up output or a face-down output utilizing the inversion of a sheet. Accordingly, in the first embodiment, since the sides A and B are difficult to defines, the sides A and B are defined as shown in FIG. 13. In FIG. 13, "Simp (Invet)" represents printing on one side of an inverted sheet. "Simp (Straight)" represents printing on one side of a non-inverted sheet, and "Duplex" represents printing on both side of a sheet. In the image forming apparatus according to the first embodiment, since an image is transferred to the top surface of a sheet by the secondary transfer unit 29, the leading image area Zi and the trailing image area Zt shown in FIG. 11 coincide with the sheet transporting direction on the side A of the sheet. It is to be noted, however, that, on the side B of the sheet, since an image inverted by the paper returning transporting mechanism 60 is transferred to the side B, the leading image area Zl and the trailing image area Zt do not coincide with the sheet transporting direction. The leading image area and the trailing image area on the side A are respectively denoted by Zl2 and Zt2, while the leading image area and the trailing image area on the side B are respectively denoted by Ztl and Zl1.

FIGS. 14(*a*) to 14(*c*) are tables which show conditions for determining the on/off state of each of the decurlers on the basis of image contents on the sides A and B defined in the above-described manner.

The relationship between image content and curl is such that when a sheet to which toner is transferred is thermally fixed, the toner shrinks to a great extent during the cooling of the sheet and the toner-transferred surface of the sheet is curled inward. For this reason, if the image content is large, i.e., the amount of toner to be printed is large, the surface of the sheet that has a large amount of toner shrinks inward. For this reason, in FIGS. 14(*a*) to 14(*c*), the conditions of the decurlers are determined in view of the relationship between image content and curling direction.

In each of FIGS. 14(*a*), 14(*b*) and 14 (*c*), the conditions are determined according to the humidity of an environment under which the image forming apparatus is placed or the humidity of the inside of a sheet tray. In the first embodiment, the case in which a humidity M is less than 40% is shown in FIG. 14(*a*) as a first condition, the case in which the humidity M is not less than 40% and less than 70% is shown in FIG. 14(*b*) as a second condition, and the case in which the humidity M is not less than 70% is shown in FIG. 14(*c*) as a third condition.

Incidentally, each of the numerical values arrayed in the row of side A and those arrayed in the column of side B shows the proportion of an image content to a maximum density of 100 (an image content ratio).

It is assumed here that the humidity M is less than 40% and the image content ratios on the sides A and B are 8% and 35%, respectively. In this case, the amount of toner on the side B is large compared to the side A, and the sheet is curled downward. In this case, from the first column (~10%) of side A of FIG. 14(*a*) and the fourth row (−40%) of side B of FIG. 14(*a*) , it can be seen that the on/off condition of the decurlers is "1". This condition means that, as shown in FIG. 12, the decurler (1) needs to be turned on, i.e., curl correction needs to be carried out so that the sheet is curved inward in the upward direction (outward in the downward direction)

Incidentally, in the case of simple printing, according to the presence or absence of inversion, the first row or column (the image content ratio: ~10%) of each of the tables shown in FIGS. 14(*a*), 14(*b*) and 14(*c*) may be selected to determine the on/off condition of the decurlers.

Although the decurler condition can be determined from FIGS. 14(*a*), 14(*b*) and 14(*c*) in the above-described manner, these tables are set so that, in many occasions, the condition of "−1" is selected, i.e., the decurler (2) is turned on. A down curl occurring when an edge portion of a sheet is curved downward can be corrected owing to its own weight, but an up curl occurring when an edge portion of a sheet is curved upward cannot be corrected by itself, and the postprocessing unit is susceptible to such up curl. For these and other reasons, the decurler (2) for effecting downward correction (correction of an up curl) is given greater weight in curl correction.

On the basis of these decurler conditions, the control unit 70 controls the decurling unit 80 to execute decurling.

Specifically, the control unit 70 finds an image content as to the leading end portion of a sheet (in the first embodiment, the leading ⅓ area of the sheet) and an image content as to the trailing end portion of the sheet (in the first embodiment, the trailing ⅓ area of the sheet) in the previously-described way on the basis of information such as image information transmitted from the IPS 21 and sheet-size information recognized by the IPS 21. The control unit 70 determines the on/off condition of the decurlers on the basis of the above-described conditions.

Then, in the image forming apparatus shown in FIG. 2, the timing when the sheet passes through the first decurler 100 and the second decurler 110 in the decurling unit 80 is checked while the state of transportation of the sheet is being checked by means of the exit sensor 48 as well as various sheet sensors (not shown) provided in the apparatus. In accordance with this timing, the above-described motor and the solenoid clutch 150 in the decurling unit 80 are turned on/off to determine a cam position and rotate the integrated cam 120, whereby the first decurler 100 and the second decurler 110 are switched on/off for each sheet to execute curl correction. In the first embodiment, the above-described control makes it possible to realize far finer curl correction conforming to the actual states of curls.

A second embodiment of the present invention will be described below.

Although in the first embodiment the control unit 70 carries out decurling with an identical decurler for each sheet, in the second embodiment, the control unit 70 controls the second decurler 110 so that the second decurler 110 operates in synchronism with the trailing edge portion of a sheet.

Specifically, in a manner similar to that described previously in connection with the first embodiment, the decurling unit 80 in controlled in accordance with the transportation timing of a sheet by predicting the status of a curl as shown in FIGS. 14(*a*), 14(*b*) and 14(*c*). If the sensor 88 in the decurling unit 80 detects the trailing edge portion of the sheet, the integrated cam 120 is moved to operate the second decurler 110 once.

Thus, even in the case of a sheet is curl-corrected by the first decurler 100 in a direction in which an edge portion of a sheet is raised, the trailing edge portion of the sheet can be curl-corrected by the second decurler 110 in a direction in which the edge portion of the sheet is lowered, whereby stacking performance for sheets delivered from the decurling unit 80 is improved.

Although in the second embodiment the second decurler 110 is moved in accordance with the sensor 88 in the decurling unit 80, there may be a case in which the motion of the integrated cam 120 cannot follow the transporting speed of a sheet if the transporting speed is fast. Accordingly, it is preferable to adopt the control of inferring in advance a timing when the sheet passes through the first decurler 100, and controlling the second decurler 110 so that the second decurler 110 reliably works on the trailing edge portion of the sheet at an earlier timing. By carrying out this control, it is possible to remove an up curl from the trailing edge portion of the sheet even if the transporting speed of the sheet in fast.

As described above, in accordance with the present invention, it is possible to apply appropriate curl correction to a sheet on which an image is formed, whereby stacking performance for delivered sheets can be improved.

What is claimed is:

1. A curl correcting unit for performing curl correction on a sheet on which an image is formed by an image forming apparatus, comprising:

a first curl correcting part that applies pressure to the sheet and performs curl correction in a direction to raise an edge portion of the sheet; and a second curl correcting part that applies pressure to the sheet in the opposite direction of the direction in which said first curl correcting part applies pressure to the sheet and performs curl correction in a direction to lower an edge portion of the sheet, wherein the second curl correcting part is positioned downstream of a sheet transporting part with respect to the first curl correcting part, and the pressure by the second curl correcting part is continuously applied to the sheet at least during transportation of the sheet.

2. The curl correcting unit according to claim 1, further comprising:

a driving part that operates the first curl correcting part and the second curl correcting part, the driving part being driven on the basis of a state of curling of the sheet grasped by the image forming apparatus.

3. The curl correcting unit according to claim 2, wherein the driving part has a cam mechanism part and drives the first curl correcting part and the second curl correcting part at the same time.

4. A curl correcting unit for performing curl correction on a sheet on which an image is formed by an image forming apparatus, comprising;

a first curl correcting section that applies pressure to the sheet and performs curl correction in a direction to raise an edge portion of the sheet;

a second curl correcting section that applies pressure to the sheet and performs curl correction in a direction to lower an edge portion of the sheet, and is positioned downstream of a sheet transporting path with respect to the first curl correcting section; and a control section that, after the sheet has passed through the first curl correcting section, drives the second curl correcting section and performs curl correction on a trailing edge portion of the sheet.

5. The curl correcting unit according to claim 4, further comprising:

a sensor that detects the sheet between the first curl correcting section and the second curl correcting section, wherein the control section drives the second curl correcting section by detecting the trailing edge portion of the sheet by the sensor.

6. An image forming apparatus for sequentially forming an image while continuously transporting a plurality of sheets with a predetermined space interposed therebetween, comprising:

a first curl correcting unit that applies pressure to a sheet being transported and performs curl correction in a direction to raise an edge portion of the sheet; and a second curl correcting unit that applies pressure to the sheet being transported and performs curl correction in a direction to lower the edge portions of the sheet, wherein the second curl correcting unit is disposed at a location away from the first curl correcting unit by a predetermined space, and the space between the first curl correcting unit and the second curl correcting unit is smaller than the space between sheets continuously transported.

7. The image forming apparatus according to claim 6, further comprising:

a fixing unit that fixes an image transferred to each of the sheets, wherein the space between the first curl correcting unit and the second curl correcting unit is smaller than a space to be formed between a plurality of sheets after the plurality of sheets have been delivered from the fixing unit.

8. The image forming apparatus according to claim 6, further comprising:

a driving part that drives switching-on/off of the first curl correcting unit and switching-on/off of the second curl correcting unit at the same time.

9. An image forming apparatus comprising:

an image forming part that forms an image on a sheet on the basis of input image information;

a curling state detecting part that detects a state of curling which may occur on the sheet on which the image is formed by the image forming part;

a first pressure part that applies pressure to one surface of the sheet on which the image is formed by the image forming part;

a second pressure part that applies pressure to the other surface of the sheet on which the image is formed by the image forming part, the second pressure part being disposed downstream of the first pressure part; and a driving part with a driving element in the driving part has a cam mechanism that drives the first pressure part and the second pressure part by the same driving part on the basis of a result of the detection made by the curling state detecting part;

wherein the cam mechanism is integrally provided with two cams which differ from each other in phase, and forms three modes for controlling the first pressure part and the second pressure part by using a single sensor and a single light blocking disk.

10. The image forming apparatus according to claim 9, wherein the cam mechanism forms the three modes during one rotation of the two cams.

11. The image forming apparatus according to claim 9, wherein the three modes are a down-curl correction mode, an up-curl correction mode and a curl non-correction mode.

12. An image forming apparatus comprising:

an image forming part that forms an image on a sheet on the basis of input image information;

a curling state detecting part that detects a state of curling which may occur on the sheet on which the image is formed by the image forming part;

a first pressure part that applies pressure to one surface of the sheet on which the image is formed by the image forming part, wherein the first pressure part is provided with a first hard roll and a first soft roll facing the first hard roll and held by a rotatable first lever;

a second pressure part that applies pressure to the other surface of the sheet on which the image is formed by the image forming part, wherein the second pressure part is provided with a second hard roll and a second soft roll facing the second hard roll and held by a rotatable second lever, the second pressure part being disposed downstream of the first pressure part; and a driving part that drives the first pressure part and the second pressure part by the same driving part on the basis of a result of the detection made by the curling state detecting part.

13. The image forming apparatus according to claim 12, wherein a rotational center of the first lever and the second lever is positioned at an approximately middle point of a line which connects the center of the first soft roll and the center of the second soft roll.

14. The image forming apparatus according to claim 12, wherein the rotational center of the first lever and the second lever in positioned at an approximately middle point of a line which connects the center of the first hard roll and the center of the second hard roll.

* * * * *